US009063515B2

(12) United States Patent
Decosterd

(10) Patent No.: US 9,063,515 B2
(45) Date of Patent: Jun. 23, 2015

(54) WATCH WITH IMPROVED POWER RESERVE

(71) Applicant: ETA SA Manufacture Horlogere Suisse, Grechen (CH)

(72) Inventor: Cedric Decosterd, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/514,574

(22) Filed: Oct. 15, 2014

(65) Prior Publication Data

US 2015/0124572 A1 May 7, 2015

(30) Foreign Application Priority Data

Nov. 6, 2013 (EP) ..... 13191775

(51) Int. Cl.

| | |
|---|---|
| ***G04B 13/02*** | (2006.01) |
| ***G04B 11/02*** | (2006.01) |
| ***G04B 3/04*** | (2006.01) |
| ***G04B 5/00*** | (2006.01) |

(52) U.S. Cl.

CPC ..... *G04B 13/02* (2013.01); *G04B 11/022* (2013.01); *G04B 3/04* (2013.01); *G04B 5/002* (2013.01)

(58) Field of Classification Search

CPC ..... G04B 11/02; G04B 13/02; G04B 1/022; G04B 3/04; G04B 5/0021

USPC ..... 368/145–150, 206–208

See application file for complete search history.

(56) References Cited

U.S. PATENT DOCUMENTS

| | | | | |
|---|---|---|---|---|
| 3,306,025 | A * | 2/1967 | Kocher | 368/148 |
| 3,628,325 | A * | 12/1971 | Morita | 368/148 |
| 5,119,348 | A * | 6/1992 | Mathys | 368/151 |
| 8,038,341 | B2 * | 10/2011 | Reynard | 368/147 |

FOREIGN PATENT DOCUMENTS

| | | |
|---|---|---|
| FR | 661 811 | 7/1929 |
| FR | 1 155 071 | 4/1958 |
| WO | WO 2012/127036 A1 | 9/2012 |
| WO | WO 2012/168443 A2 | 12/2012 |

OTHER PUBLICATIONS

European Search Report issued May 20, 2014 in European Application 13191775, filed on Nov. 6, 2013 ( with English Translation).

* cited by examiner

*Primary Examiner* — Vit W Miska

(74) *Attorney, Agent, or Firm* — Oblon, McClelland, Maier & Neustadt, L.L.P.

(57) ABSTRACT

Mechanical timepiece movement, including at least one energy storage means fed at the input by a ratchet driven by one winding mechanism and at the output powering a going train. The movement includes first energy take-up means connected to at least one wheel set of this going train by at least a first elastic connection, this first energy take-up means cooperating with at least one wheel set driving this ratchet, in mesh with this ratchet for powering this energy storage means by reinjecting part of the energy taken up by this energy take-up means, this wheel set driving this ratchet being uncouplable under the action of at least one uncoupling mechanism active during the operation of this winding mechanism.

15 Claims, 7 Drawing Sheets

WATCH WITH IMPROVED POWER RESERVE

This application claims priority from European patent application No. 13191775.9 filed Nov. 6, 2013, the entire disclosure of which is hereby incorporated herein by reference.

FIELD OF THE INVENTION

The invention concerns a mechanical timepiece movement, including at least one energy storage means fed at the input by a ratchet driven by at least one winding mechanism and at the output powering a going train.

The invention also concerns a timepiece comprising at least one movement of this type.

The invention concerns the field of mechanical timepiece movements.

BACKGROUND OF THE INVENTION

The power reserve of timepiece mechanisms is constant preoccupation, which is amplified by the number of energy-consuming complications and mechanisms in a calibre. To increase the power reserve, it is possible to reduce the oscillator frequency or the power to the escapement, and/or to increase the power available in the barrel or barrels. In all cases, the going train, regulation and mainspring have to be changed, which constitutes a significant and expensive modification of an existing calibre. Further, the space available rarely allows for an extension of the barrel, and change is therefore limited to action on the regulating system.

FR Patent Application No 1155071 A in the name of Nicolet Watch discloses an automatic winding device for a watch mounted in a vehicle provided with a speedometer, which includes a gear box intended to be fixed, on the one hand, to the end of the cable actuating the speedometer, and on the other hand, to the actual speedometer, and means connected to the gear box for transmitting the rotational motion from the cable to the speedometer and to the mainspring of the watch.

WO Patent Application No 2012/168443 A2 in the name of Haute Ecole Arc/Pascal Winkler discloses a mechanical energy source for a timepiece movement having a predefined output torque transmitted to a first wheel set of the going train. This mechanism includes a mainspring whose ends are integral with an arbor and with a barrel drum, one of these ends being intended to be kinematically connected to the first wheel set of the going train. The mechanism includes a gear train arranged to ensure a kinematic connection between the ends of the mainspring and to allow for a transfer of energy therebetween. The gear train includes a planetary train.

This planetary train includes a first input-output intended to be kinematically connected to a mainspring winding mechanism, a second input-output kinematically connected to one end of the mainspring, and a third input-output kinematically connected to the other end of the mainspring. The planetary train includes a satellite wheel including a non-circular wheel arranged in mesh with a first non-circular solar wheel.

SUMMARY OF THE INVENTION

It is an object of the invention to reinject torque into the barrel by take-up from the going train, in order to increase the power reserve of an existing movement, by reducing the power discharged to the escapement without modifying the basic gear train.

To this end, the invention concerns a mechanical timepiece movement, including at least one energy storage means fed at an input by a ratchet driven by at least one winding mechanism and at an output powering a going train, characterized in that the mechanism includes first energy take-up means connected to at least one wheel set of said going train by at least a first elastic connection forming an uncoupling mechanism, said first energy take-up means taking up energy from said going train which is powered by said energy storage means, and said first energy take-up means cooperating with at least one ratchet drive wheel set, said drive wheel set is in mesh with said ratchet to feed said energy storage means by reinjecting part of the energy taken up by said energy take-up means.

According to a feature of the invention, said at least one ratchet drive wheel set is uncouplable under the action of at least one uncoupling mechanism active during the operation of said at least one winding mechanism.

The invention also concerns a timepiece comprising at least one movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
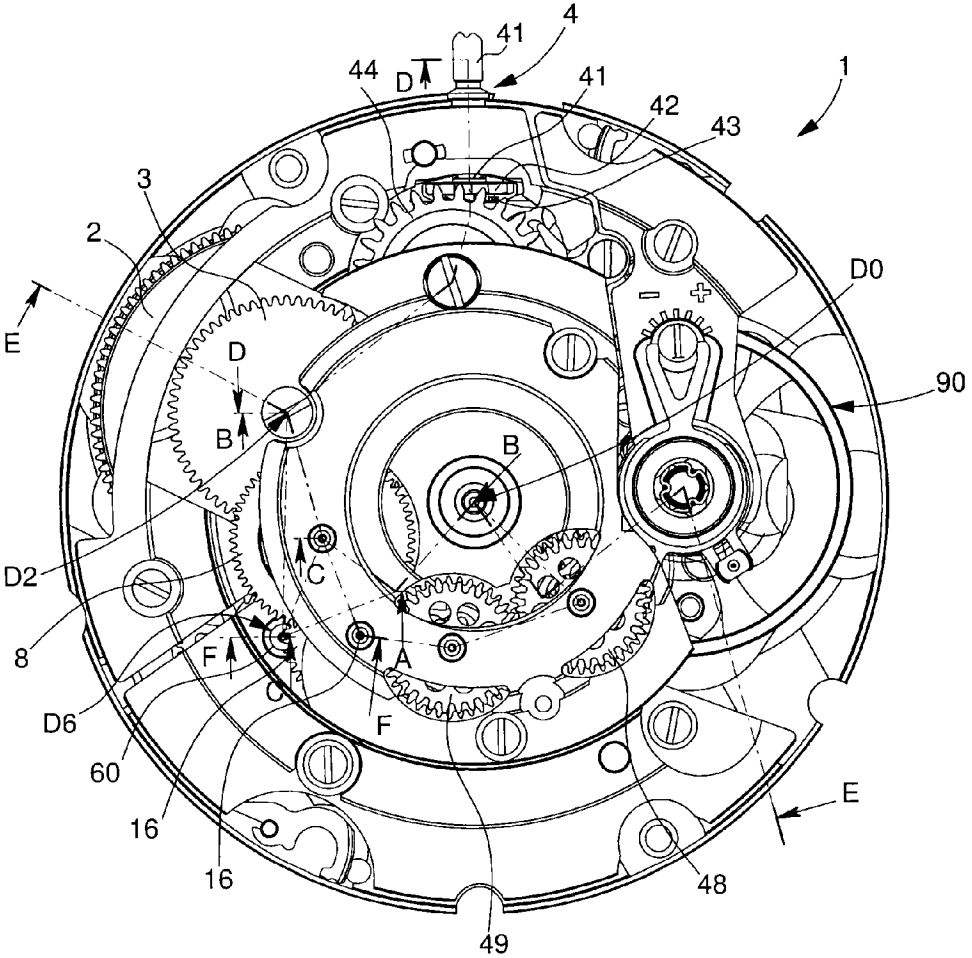
FIG. 1 shows a schematic, plan view of a watch including a mechanical movement, which includes a mechanical energy accumulator in the form of a barrel, and a regulating mechanism, said movement having an improved power reserve with an energy reinjection mechanism according to the invention.
Figure 2:
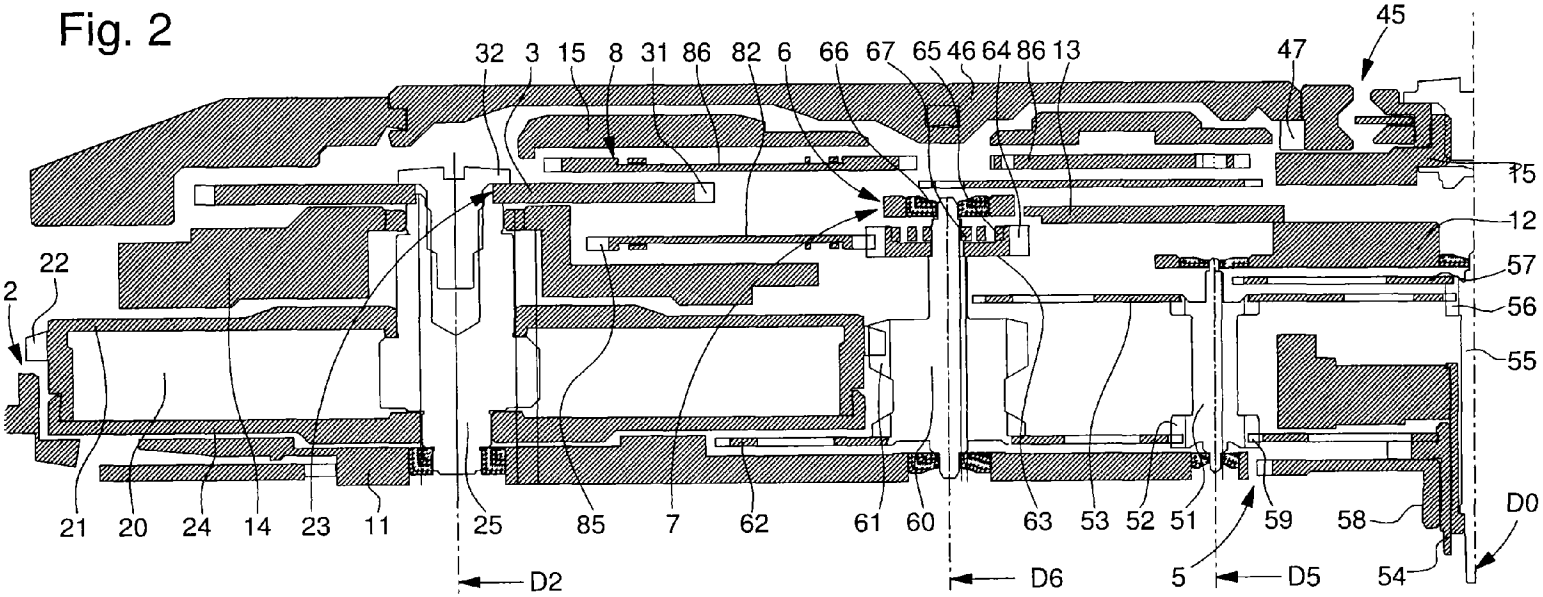
FIG. 2 shows a partial, schematic cross-section view, along the line EE, of the movement of FIG. 1, and shows in particular the going train.
Figure 3:
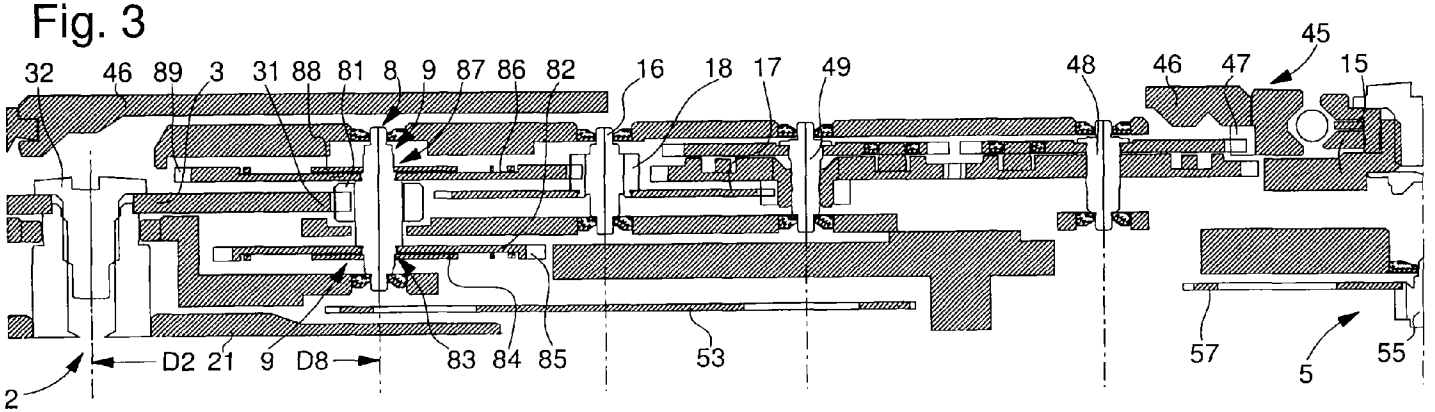
FIG. 3 shows a partial, schematic cross-section view, along the line BB, of the movement of FIG. 1 and shows in particular the automatic gear train.
Figure 6:
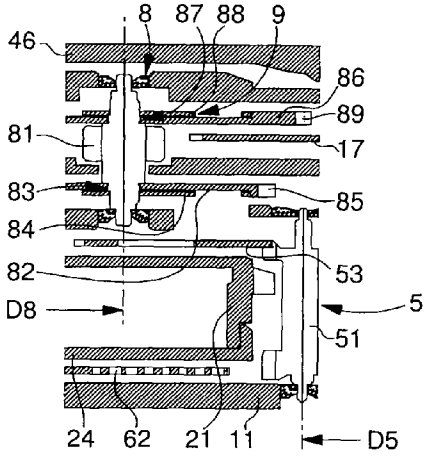
FIG. 6 shows a partial, schematic cross-section view, along the line AA, of the movement of FIG. 1 and shows in particular the ratchet drive wheel set.
Figure 7:
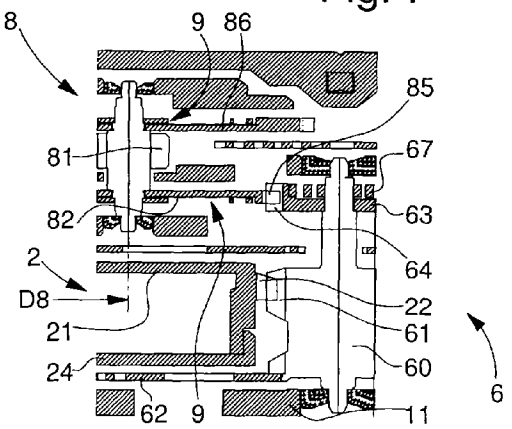
FIG. 7 shows a partial, schematic cross-section view, along the line CC, of the movement of FIG. 1 and shows in particular the train of the reinjection mechanism.
Figure 4:
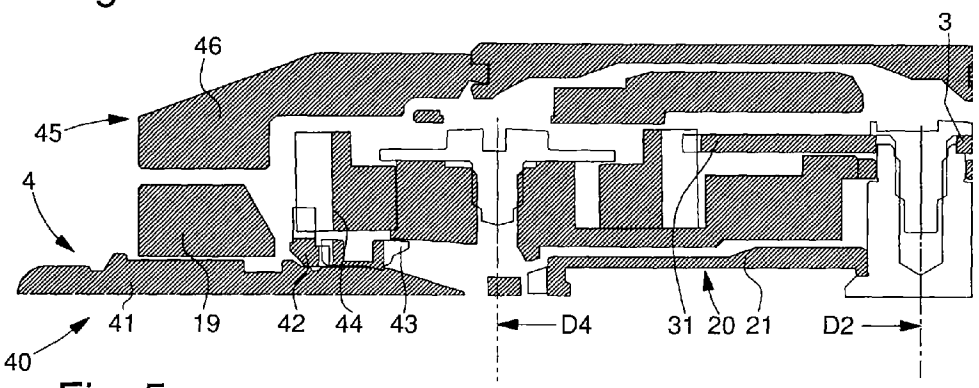
FIG. 4 shows a partial, schematic cross-section view, along the line DD, of the movement of FIG. 1, and shows in particular the manual winding mechanism.
Figure 5:
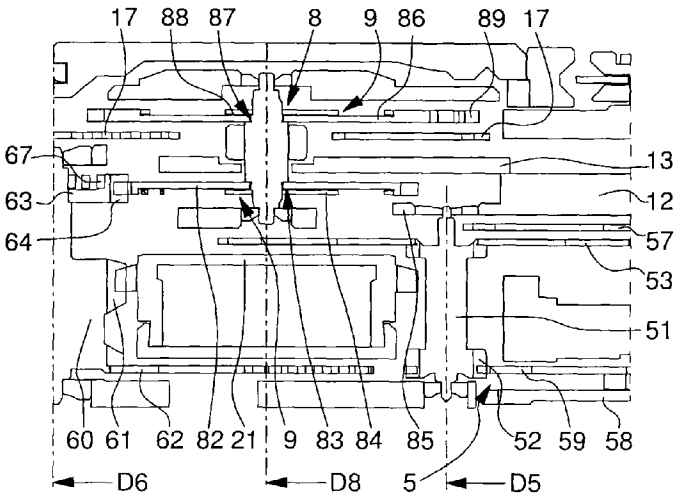
FIG. 5 shows a partial, schematic cross-section view, along the line FF, of the movement of FIG. 1 and in particular shows the reinjection mechanism.

It is an object of the invention to reinject torque into an energy storage means, particularly at least one barrel, by take-up from the going train 5 of a mechanical timepiece movement 1 of a watch 100, in order to increase the power reserve of an existing movement, by decreasing the power discharged to the escapement, without however modifying the gear basic train.

For the sake of simplification, the invention is described here for the non-limiting case where the energy storage means is a barrel 20. It is understood that the invention is applicable to other energy storage means: several barrels, linear elastic means, physicochemical energy conversion via hydrides or similar, or other means.

To reduce the power in the escapement, it is in fact theoretically possible to take part of the torque directly from the going train. This additional torque can be reinjected straight into the barrel in order to increase its capacity.

Barrel 20 is equipped with a ratchet 3. This ratchet 3 receives energy from a manual winding mechanism 40 and/or an automatic mechanism 45 and/or a reinjection mechanism according to the invention, and/or any additional energy intake means, such as a solar power converter or other device, and charges the barrel with the energy that it receives.

Barrel 20 transmits torque to a going train 5. A first part of this torque is transmitted to an ordinary escapement mechanism which is not described in detail here. A second additional part of this torque is extracted by first energy take-up means 6 according to the invention, and transferred to ratchet 3.

This reinjection principle appears to be relatively simple, since torque is simply taken from going train 5 and the surplus torque is used to wind barrel 20. However, it involves a certain number of problems that must be resolved.

First of all, the torque must be taken-up as close as possible to barrel 20 since the efficiency of the system depends above all on the number of wheel sets it requires in order to operate. If the torque is raised from a rapidly rotating wheel, for example the seconds wheel, a large multiplier train will be required in order to wind barrel 20.

In a conventional movement 1, the torque in the gear train is transmitted by the drum 21 of barrel 20. It is therefore impossible to reinject torque through toothing 22 of drum 20, since the speed is defined by the escapement and the reduction of going train 5. It is thus necessary to reinject the torque straight through ratchet 3. Consequently, a unidirectional or uncouplable system must be installed between the reinjection system train and ratchet 3. Without a system of this type to ensure safety, during manual or automatic winding, the torque given to ratchet 2 would be transmitted straight across the gear train by the reinjection system, which would cause an increase in torque in the escapement, resulting in a massive increase in amplitude and knocking.

In the case of a movement 1 with an automatic mechanism 45, ratchet 3 can be driven at any time by a motion of the oscillating or similar automatic winding mass 46. In the embodiment illustrated in the Figures, mass 46 is carried by a frame 15 of the automatic device and a toothing 47 accomplishes the winding operation through a first reverser wheel 48 and a second reverser wheel 49. This latter drives a plate 17 of a reduction wheel set 16 provided with a pinion 18, arranged to drive a toothing 89 of a second wheel 86 of a ratchet drive wheel, according to the invention, which will be explained below.

At this moment, the manual winding mechanism 40 is automatically uncoupled. This means that for a certain time period, the energy provided by the reinjection system is lost, until the toothings between the ratchet and the uncoupling wheel are in mesh again. If watch 100 is worn by a "high" user (who frequently operates automatic winding mechanism 45), the reinjection system has only a limited effect on the power reserve of the movement, since in that case, the energy reserves are at a maximum level, while watch 100 is being worn. Further, if the system is not in mesh, all the torque remains in the going train. After a certain period of time, there is a risk of the amplitude increasing to the point of knocking.

The aforementioned points clearly demonstrate the complexity of the reinjection system.

The integration of a torque reinjection mechanism in a movement 1 having a manual winding mechanism 40 is entirely justified, since the gain in power reserve is immediately observed by the user. Further, the reinjection system is always in mesh with ratchet 3, except during winding via a stem 41. In principle, a user who has a manual movement winds his watch only 3 to 4 times per week, depending upon the power reserve of the watch. The potential loss of energy during this period is thus imperceptible.

The integration of a torque reinjection mechanism into a movement 1 having an automatic winding mechanism 45 is useful when watch 100 is not being worn, for example if it is taken off for several days over the weekend. At this time, an increase is power reserve is appreciated so that the user does not have to wind his watch on Monday morning.

The architecture of the mechanism according to the invention is presented below, the justification calculations will be set out in the description below.

The invention also concerns a mechanical timepiece movement 1 including at least one energy storage means 2, particularly a barrel 20.

This barrel 20 includes a drum 21, with a toothing 22, a cover 24 and an arbor 25.

This energy storage means 2 is fed at an input by a ratchet 3 driven by at least one winding mechanism 4 and at an output powers a going train 5. Ratchet 3 includes a toothing 31, drive means 23 for cooperating with arbor 25 and a fixing element 32. Going train 5 includes, in a conventional manner, a third wheel 51 with a pinion 52 and a plate 53, a minute cannon-pinion 54 with a toothing 59, a seconds wheel set 55 with a pinion 56 and a plate 57, and an hour wheel 58.

The various components of movement 1 are housed, according to the case and as seen in the various Figures, on a dial support plate 11, a train bar 12, a lower automatic device bar 13, a barrel bar 14, the automatic device frame 15, and a winding stem 19.

According to the invention, this movement 1 includes first energy take-up means 6, which are connected to at least one wheel set of going train 5 by at least a first elastic connection 7 forming an uncoupling mechanism.

These first energy take-up means 6 cooperate with at least one wheel set 8 for driving ratchet 3, which is in mesh with ratchet 3, to feed energy storage means 2 by reinjecting part of the energy taken up by energy take-up means 6.

Advantageously, this at least one wheel set 8 for driving ratchet 3 can be uncoupled under the action of at least one uncoupling mechanism 9 active during the operation of at least one winding mechanism 4.

Advantageously, the first elastic connection 7 forming the uncoupling mechanism, is inserted between energy take-up means 6 and ratchet 3.

According to the invention, energy take-up means 6 are located downstream of energy storage means 2 on at least one intermediate wheel set 60.

Figure 8:
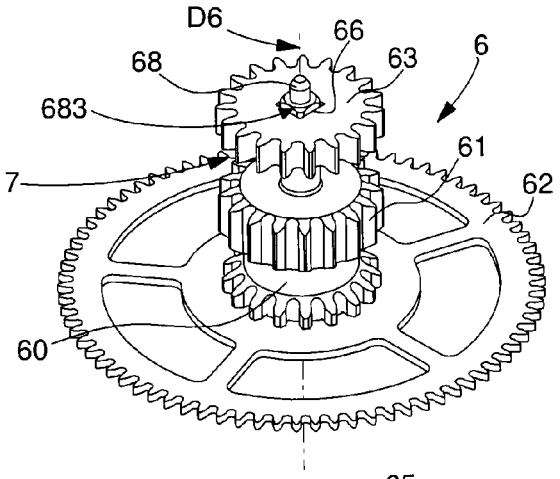
FIG. 8 shows a schematic, perspective view of an intermediate wheel set comprised in the energy reinjection mechanism, this intermediate wheel set including an intermediate wheel which is partially free to pivot and connected by elastic return means to an arbor integral with a first pinion.

This intermediate wheel set 60, illustrated in FIG. 8, includes, coaxially arranged about an arbor 68, and on either side of a first pinion 61 driven by energy storage means 2, in particular the toothing 22 of a drum 21 of a barrel 20:

- on the one hand, an intermediate wheel for connection with a wheel set of going train 5, this intermediate wheel 62 pivoting integrally with first pinion 61,
- and on the other hand, an additional intermediate connecting wheel 63, including a toothing 64 and meshing with a wheel set 8 for driving ratchet 3, the additional intermediate wheel 63 being pivotally mounted on an arbor 68 comprised in intermediate wheel set 60 and connected to said arbor 68 by first elastic rotational return means or at least a main spring 67 constituting first elastic connection 7 and inserted in a housing 65 of wheel 63 and in a housing 66 of intermediate wheel set 60.

Figure 9:
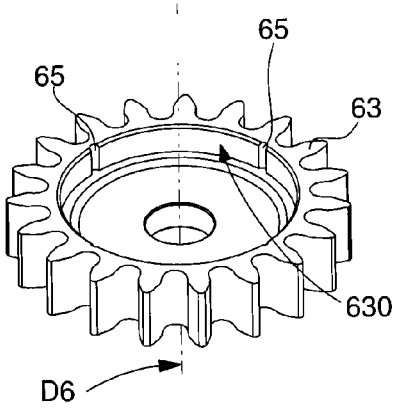
FIG. 9 shows a schematic, perspective view of the intermediate wheel of FIG. 8.

Supplementary intermediate wheel 63 is shown in FIG. 9, in an advantageous embodiment which includes a recess 630 for housing a main spring 67. This spring 67 includes an outer coil 651 housed in recess 630 in which it is prevented from pivoting by the cooperation of lugs 650 of spring 67 with notches 65 in wheel 63 or vice versa. Spring 67 includes at least one spiral strand 654 which joins outer coil 651 to an inner coil 652 which includes pivoting preventing means 653 on arbor 68 of intermediate wheel set 60. Here the preventing means 653 are a female square cooperating with a male square 683 of arbor 68. During operation, additional intermediate wheel 63 pivots freely on arbor 68 of intermediate wheel 62 driven by spring 67 whose inner coil 652 is thus fixedly connected to arbor 68 of wheel set 60.

Figure 10:
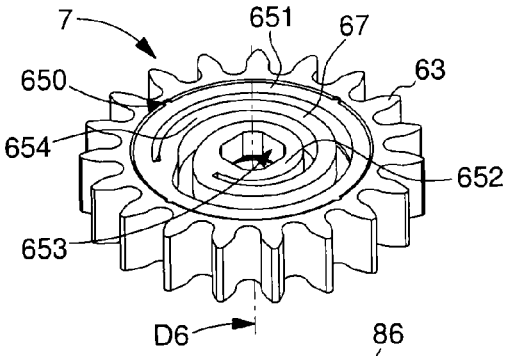
FIG. 10 shows a schematic, perspective view of the intermediate wheel of FIG. 8 equipped with its means of elastic return towards an angular rest position relative to the arbor.

The spiral-shaped geometry of spring 67 defined by the calculation is shown in FIG. 10. In order to maximise the number of winding turns of the spring, the coil must be as long as possible while observing "LIGA" manufacturing constraints, in the preferred case of an embodiment of this type. The geometry is optimised in order to ensure winding calculated to be equivalent to 18°. For a higher torque, the outer point of attachment of the coil to the centre can certainly come into contact with the inner point of attachment of the coil to the ring (red circle), which does not cause any problems and even makes it possible to partially relieve the stresses inside the coil.

In the usual manner, at least one winding mechanism 4 of movement 1 is a manual winding mechanism 40 actuated by the user. Also, at least one wheel set 8 driving ratchet 3 according to the invention includes at least a first additional ratchet drive wheel 82 which is coaxial with a pinion 81 engaging with ratchet 3. This first additional ratchet drive wheel 82 carrying a toothing 85 arranged to cooperate with the toothing 64 of additional intermediate wheel 63, is pivotally mounted on a shoulder 83 of an arbor 80 comprised in the wheel set 8 driving ratchet 3. This first additional ratchet drive wheel 82 is connected to arbor 80 by first elastic rotational return means or at least a first spring 84 constituting first uncoupling means 9, during the operation of manual winding mechanism 40 actuated by the user. A first additional ratchet drive wheel 82 of this type is visible in the bottom part of a more complex wheel set illustrated in FIG. 11.

Preferably, some of these uncoupling means 9, constituted by the first elastic rotational return means or by the at least one first spring 84, exert a friction force on first additional ratchet drive wheel 82, whose moment of torque is different according to the relative pivoting direction between uncoupling means 9 and first additional ratchet drive wheel 82.

Specifically, first spring 84 is thus arranged to generate a unidirectional pivoting direction with no play of the first additional ratchet drive wheel 82 relative to arbor 80 of wheel set 8 driving ratchet 3, so as to prevent any transmission of torque to train 5 during the winding of movement 1 by at least one winding mechanism 4 of this type.

Figure 11:
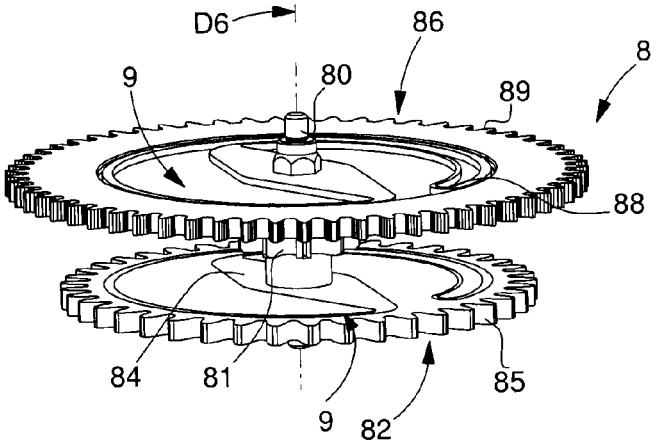
FIG. 11 shows a schematic, perspective view of an assembled ratchet drive wheel set according to the invention, including, on both sides of an arbor, a first wheel, which is partially free to pivot and connected by elastic return means to said arbor, and a second wheel, also partially free to pivot and connected by elastic return means to said arbor.

When at least one winding mechanism 4 is an automatic winding mechanism 45, at least one wheel set 8 driving ratchet 3 further includes a second additional ratchet drive wheel set 86, as seen in FIG. 11. This second additional ratchet drive wheel set 86 carrying a toothing 89 arranged to cooperate with pinion 18 of reduction wheel set 16, is pivotally mounted on a shoulder 87 of arbor 80, and is connected to said arbor 80 by second elastic rotational return means or to at least a second spring 88 constituting uncoupling means 9 during the operation of automatic winding mechanism 45. In short, on one side of ratchet drive wheel set 8, there is arranged the reinjection system, and on the other side, the automatic winding mechanism, which explains the requirement for an uncoupling system between the two torque inputs.

Preferably, some of uncoupling means 9, constituted by these second elastic rotational return means or by the at least one second spring 88, exert a friction force on second additional ratchet drive wheel 86, whose moment of torque is different according to the relative pivoting direction between uncoupling means 9 and second additional ratchet drive wheel 86.

Specifically, the second spring 88 is thus arranged to generate a unidirectional direction of pivoting with no play of the second additional ratchet drive wheel 86 relative to arbor 80 of wheel set 8 driving ratchet 3, so as to prevent any transmission of torque to going train 5 during the winding of movement 1 by manual winding mechanism 40 actuated by the user, or during the operation of the first energy take-up means 6.

The design of wheel set 8 driving ratchet 3 therefore takes account of the various functions to be performed:

- transmitting torque from the train of automatic winding mechanism 45 to ratchet 3;
- transmitting torque from the reinjection system;
- uncoupling the torque transmission between the two systems, which requires the use of unidirectional wheels.

It is important, during winding by automatic winding mechanism 45, that the torque in the wheel set does not drive the reinjection system since, otherwise, the additional torque in the going train via the reinjection system would risk causing knocking. In the opposite direction, during driving by the reinjection system, it is necessary to avoid driving any of the wheels of automatic winding mechanism 45 up to the click wheels, in order to minimise losses.

FIG. 11 shows the mounted ratchet drive wheel set, composed of five parts: a preferably 20AP steel turned arbor 80, first additional ratchet drive wheel 82 and second additional ratchet drive wheel 86, which pivot freely, and first spring 84 and second spring 88 which ensure that these wheels are driven or not driven.

As regards the unidirectional first additional ratchet drive wheel 82 and second additional ratchet drive wheel 86, manufactured preferably in hardened copper-beryllium (CuBe), their function is to drive arbor 80 when they undergo torque derived either from automatic winding mechanism 45 or from the reinjection system. However, they must not transmit torque when they are driven by arbor 80 (uncoupling system between the two wheels). In addition, wheel 82 or 86 must not have a dead angle, as opposed to a click wheel for example. The toothing 85 and 89 of these wheels 82 and 86 are also optimised to minimise play in the gears. The very different behaviour of each spring 84, 88, according to the direction of torque applied thereto can be simplified in a first "free" direction and in a second "friction" direction of driving. However, even in the "free" direction of the spring, there is slight friction between the spring and the wheel concerned, due to slight prestressing applied to the spring on its external diameter, which means that the wheel will be driven by this low friction torque, and will turn until it takes up the play with the next wheel or pinion.

The two wheels 82 and 86 are preferably devised to receive the same spring, which reduces the number of components. Further, their pivoting diameters are identical. This also makes it possible to have the same dimension for attaching the spring to the centre on the six-sided drive shaft of arbor 80.

The first 84 or second 88 flexible spring has the function of driving arbor 80 when it operates in a locking direction. In the event that the arbor 80 drives a spring, it should not drive the corresponding wheel. Preferably, the friction torque is minimised and the locking torque is maximised.

It is understood that this type of uncoupling system is essential to prevent any force feedback by the reinjection system during manual or automatic winding of the watch. Ratchet drive wheel set 8 forms a unidirectional wheel whose operation resembles a reverser click wheel. Wheel set 8 represents great progress compared with known reversers, since it is far less voluminous, and therefore easier to insert in immediate proximity to ratchet 3. Wheel set 8 according to the invention has no dead angle, which means that it may be mounted in an automatic movement.

Figure 12:
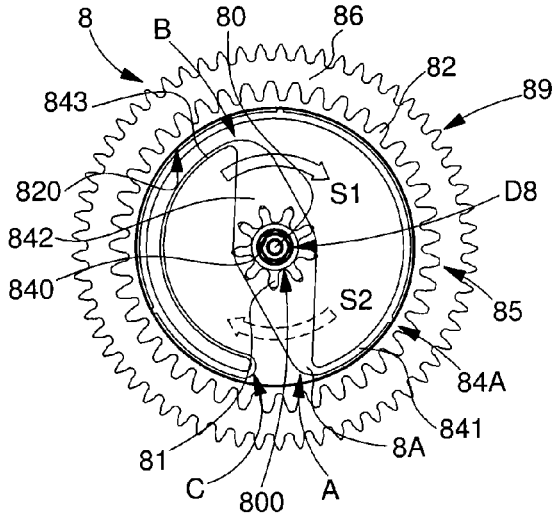
FIGS. 12 to 18 show schematic, plan views of different variants of the elastic return means equipping the first wheel and/or the second wheel of FIG. 11.

FIGS. 12 to 18 illustrate various non-limiting geometries of springs, which are equally applicable to first spring 84 or second spring 88. FIG. 12 shows more specifically first spring 84 housed in first additional ratchet drive wheel 82, and FIGS. 13 to 18 show second spring 88 housed in the second additional ratchet drive wheel 86. They are fixed to the corresponding wheel by means of friction: an external coil 841, 881 respectively, of first spring 84, respectively of second spring 88, cooperates with a housing 820, 860 respectively, of wheel 82, 86 respectively, in which it is held by friction on its edge and/or by tabs 84A, 88A respectively, comprised in said first spring 84, respectively second spring 88. The interior part of each spring, 842, 882 respectively, cooperates with arbor 80, via a female part 840, 880 respectively, of first spring 84, respectively of second spring 88, with a complementary profile to a male part 800 of arbor 80.

The specific profile of the springs illustrated, with asymmetric stiffness of at least one arm 843, 883 respectively, connecting the internal part of each spring, 842, 882 respectively, to its external part 841, 881 respectively, makes it possible to apply torque with a large difference in moment, depending on whether the relative pivoting movement between arbor 80 and the respective wheel is in one direction or the other. The torque ratio applied in one direction relative to the other is preferably higher than 3; according to the shape of the spring, the sections used, and the pairs of materials used, this ratio can be considerably increased, particularly over a factor of 10.

Figure 13:
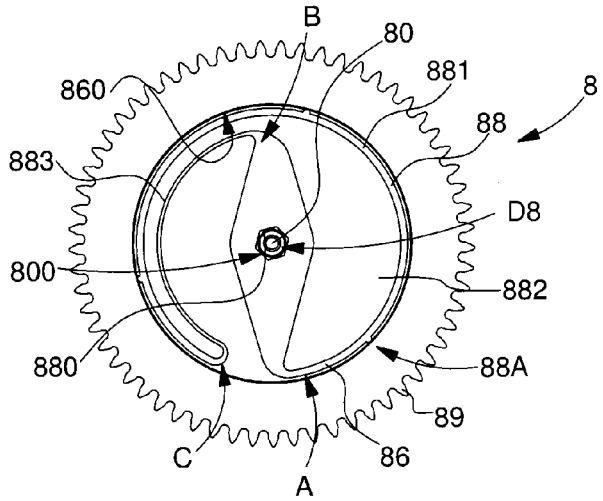

In FIGS. 12 and 13, the spring profile is closed: the internal part of each spring, 842, 882 respectively, is diamond shaped centred on arbor 80, one of the ends A of the diamond constituting the start of the external part 841, 881 respectively, which is circular for almost a complete turn, before winding around itself at point C and forming an arm 843, 883 respectively, with a circular section for about half a turn, with a smaller radius than the external part, attached to point B at the other end of the diamond symmetrically to the first end A.

Figure 14:
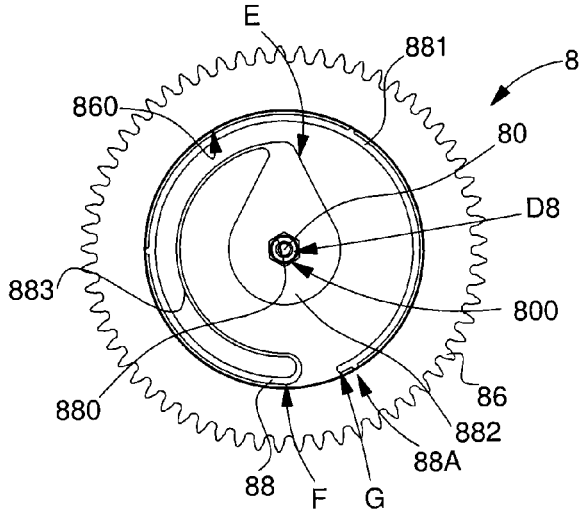

In FIG. 14, the spring profile is open: the inner part, 842, 882 respectively, has the shape of a disk extended over a radius by a triangle, whose distal point E constitutes the start of an arm 843, 883 respectively, in a circular sector of approximately half a turn, before winding around itself at point F and forming the external part 841, 881 respectively, which is circular for almost a complete turn, with a radius larger than the arm, before stopping at a distal end G.

Figure 15:
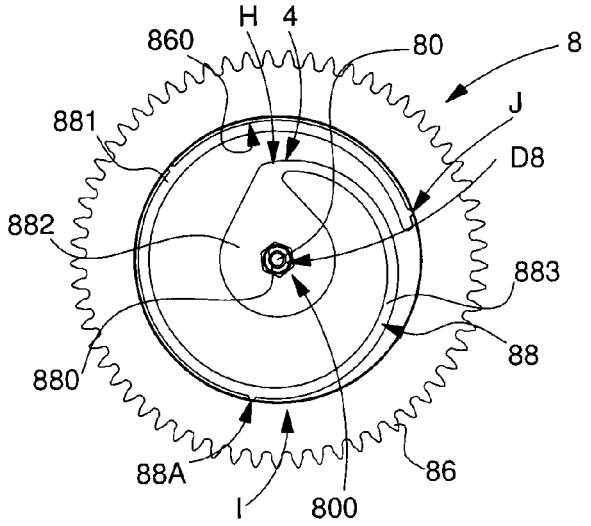

In FIG. 15, the spring profile is open: the inner part, 842, 882 respectively, has the shape of a disk extended over a radius by a triangle, whose distal point H constitutes the start of an arm 843, 883 respectively, with a spiral increasing over approximately half a turn to a point I where the circular external part 841, 881 respectively, starts, before stopping at a distal end J, after approximately one and a quarter turns in relation to point H.

Figure 16:
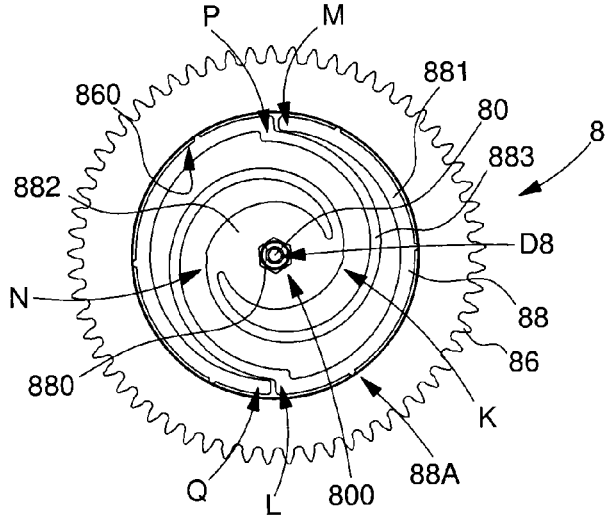

In FIG. 16, the spring profile is open, the spring including two symmetrical strands: the inner part, 842, 882 respectively, is in the shape of a disk to which is attached at K, N, an arm 843, 883 respectively, in a spiral increasing over approximately three quarters of a turn to point L, P, where a circular external part 841, 881 respectively, starts for half a turn, before stopping at a distal end M, Q.

Figure 17:
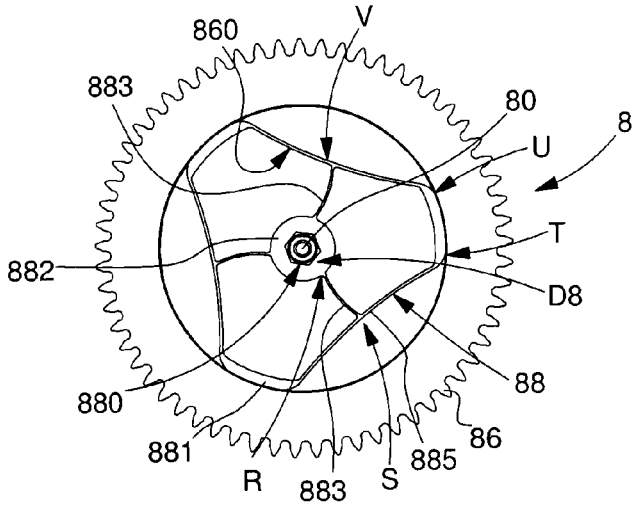

In FIG. 17, the spring profile is closed, and includes a mesh with a pitch of 120°: the inner part, 842, 882 respectively, is in the shape of a disk, from which there starts, at point R, a substantially radial but curved arm 843, 883 respectively, which joins, at point S, a chord 885 that joins two circular sectors of larger diameter, including a sector TU forming an external part 841, 881 respectively, the spring starting again from point U on another chord 885 at about 120° from the former, and joining at point V another radial curved arc similar to the first, point V being the conjugate of starting point S.

Figure 18:
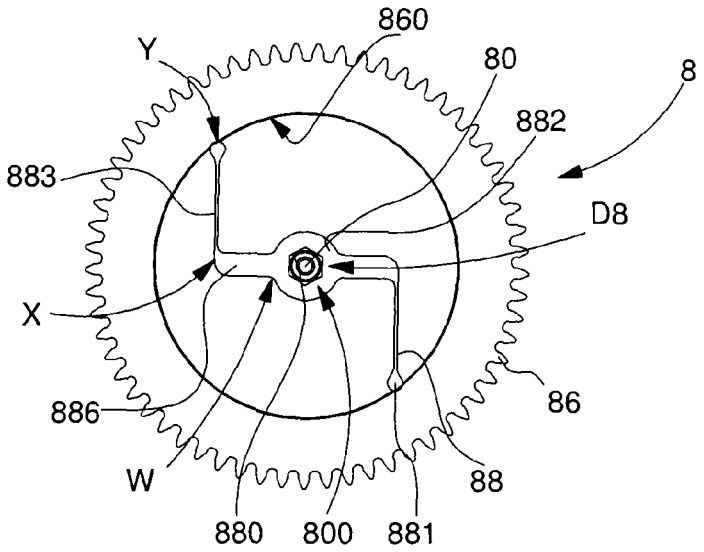
Figure 19:
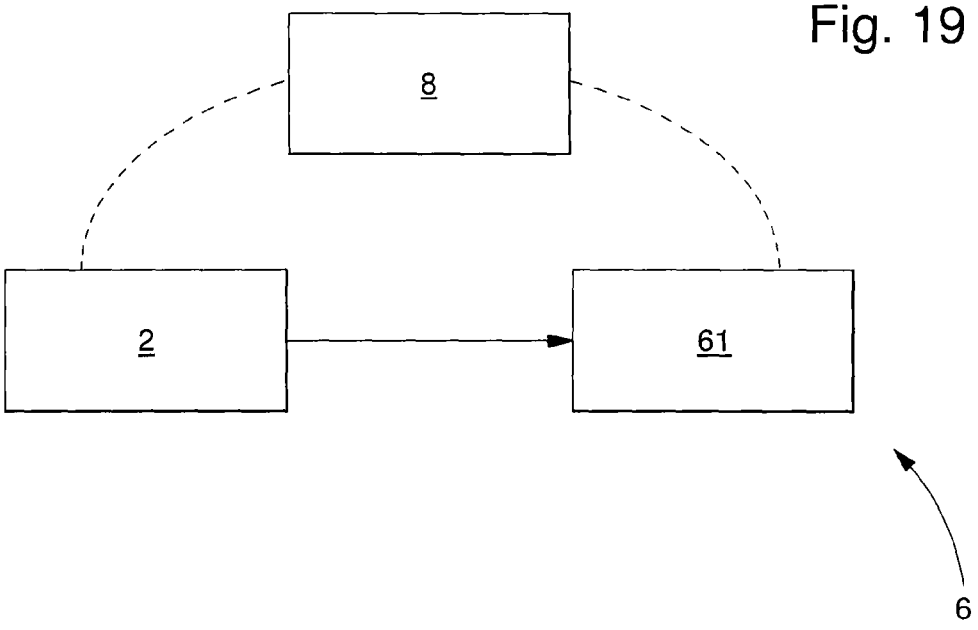
FIG. 19 shows block diagrams of the energy reinjection system according to the invention.

In FIG. 18, the spring profile is open, the spring comprising two symmetrical strands: the inner part, 842, 882 respectively, is in the shape of a disk to which is attached at W a radial arm 886 having a large section, to a point X from which projects at right angles an arm 843, 883 respectively, having a smaller section than radial arm 886, to a distal end Y at the periphery of the wheel.

The springs of FIGS. 12 to 18 can be created by stamping, or, for those with very fine strands, using a "LIGA", "DRIE" or a similar manufacturing process.

According to the invention, the main spring 67 of intermediate wheel set 60 is advantageously dimensioned and arranged to take up the play between the additional intermediate wheel 63 and additional ratchet drive wheel 82.

In a particular variant, movement 1 includes at least one regulating member 90 having a balance, and energy take-up means 6 constantly take up a mechanical torque from going train 5 when said regulating member 90 is operating. According to the invention, this balance is dimensioned less than the same movement 1 would be without energy take-up means 6 so as to maintain an oscillation amplitude sufficient for the operation thereof.

In a particular variant, movement 1 includes at least one regulating member 90 having a balance, and at least one winding mechanism 4 is an automatic winding mechanism 45, and energy take-up means 6 constantly take up mechanical torque from going train 5 only when movement 1 is held in a fixed position in space and when automatic winding mechanism 45 is inactive, thereby to decrease the oscillation amplitude of the balance and to increase the power reserve of movement 1.

Preferably, in movement 1, winding mechanism 4 includes a manual winding mechanism 40, which includes a user-actuated stem 41 and which is arranged to drive, in an axial winding position of stem 41 and in a rotational winding direction imparted thereto by the user, a sliding pinion 43 arranged to mesh with a winding pinion 42 driving a transmission wheel 44 meshing with ratchet 3. According to the invention, transmission wheel 44 is arranged to cooperate with a click 31 including means of taking up backlash between ratchet 3 and transmission wheel 44 during an operation of stem 41.

The invention also concerns a timepiece 100, particularly a watch, including at least one such movement.

The mechanism of the invention must take up the play created in the reinjection system under the action of the automatic winding mechanism, before continuing to drive the ratchet, while preventing any torque from passing through the going train and causing knocking. This is possible when the take-up of torque from the going train is constant while the movement is rotating. As regards the level of energy, the power required for the balance is reduced, by the constant take-up of torque from the going train. This involves reducing the dimensions of the balance, to ensure a satisfactory amplitude. The dimensions of the balance directly correspond to the decrease in torque taken up by the reinjection system. In the variant illustrated in the Figures, there is a change from a basic movement with an oscillator having a regulating power of 3100 ergs per second to a modified movement having a regulating power of 1120 ergs per second. This represents a decrease in inertia from 16 mg×cm$^2$ to 14 mg×cm$^2$, with a corresponding decrease in frequency from 4 Hz to 3 Hz.

When a watch having an automatic movement is worn, the movement does not require an increased power reserve. However, autonomy becomes important when the user removes his watch. Thereafter, it becomes advantageous to increase the power reserve by means of the reinjection system. Thus, for an automatically wound watch, it is possible to envisage not taking up play when the watch is worn. However, when the watch is removed, after a certain period of time which corresponds to the take-up of play (and which may vary according to the wearer), part of the going train torque is taken up by the reinjection system, which increases the power reserve in proportion to the take-up of torque. Thus all of the torque remains in the going train during wear. The balance thus remains identical to the balance of a standard movement (with no reinjection system). However, when the watch is removed and when the reinjection system starts to operate, the amplitude of the balance will decrease in proportion to the torque taken up for reinjection. However, in this case, the decrease in amplitude, which slightly impairs the chronometric performance of the watch during a period of non-use, makes it possible for several days to pass without the movement stopping, which would be impossible without the reinjection system according to the invention.

The backlash take-up system makes it possible to take up the backlash created during automatic winding, which ensures a permanent contact with the ratchet toothing even when the ratchet is driven. The use of a unidirectional wheel with no play in intermediate wheel set 60 is a good solution: this wheel rotates freely in one direction and is locked in the other, with a very low dead angle throughout. As regards backlash, a toothing geometry with reduced play could also be used, or a toothing with no play including flexible toothing elements.

The mechanism according to the invention meets the following criteria well:

safety of the system during operation, simplicity of production and implementation in an existing movement, reliability of the system for both manual and automatic movements, optimal reinjection efficiency and maximal reduction of losses, The solution with no dead angles makes it possible to increase efficiency in an automatically wound movement. The system of uncoupling using a unidirectional wheel answers the pressing need for simplicity of implementation and manufacture. This makes it possible to limit the number and complexity of components.

The functions of taking up play and locking are directly performed on each occasion by a single component.

What is claimed is:

1. A mechanical timepiece movement, including at least one energy storage means fed at an input by a ratchet driven by at least one winding mechanism and at an output powering a going train, wherein the mechanism includes first energy take-up means connected to at least one wheel set of said going train by at least a first elastic connection forming an uncoupling mechanism, said first energy take-up means taking up energy from said going train which is powered by said energy storage means, and said first energy take-up means cooperating with at least one wheel set driving said ratchet, said drive wheel set is in mesh with said ratchet to feed said energy storage means by reinjecting part of the energy taken up by said energy take-up means.

2. The movement according to claim 1, wherein said at least one drive wheel set is uncouplable under the action of said at least one uncoupling mechanism active during the operation of said at least one winding mechanism.

3. The movement according to claim 2, wherein said first elastic connection forming the uncoupling mechanism is inserted between said energy take-up means and said ratchet.

4. The movement according to claim 1, wherein said energy take-up means are located downstream of said energy storage means, on at least one intermediate wheel set which includes, arranged coaxially on both sides of a first pinion driven by said energy storage means, on the one hand, an intermediate wheel for connection to a wheel set of said going train, said intermediate wheel pivoting integrally with said first pinion, and on the other hand, an additional intermediate connection wheel meshing with said at least one wheel set driving said ratchet, said additional intermediate connection wheel being pivotally mounted on an arbor comprised in said intermediate wheel and connected to said arbor by elastic rotational return means or at least a main spring constituting said first elastic connection.

5. The movement according to claim 1, wherein at least one said winding mechanism is a manual winding mechanism actuated by the user, and in that at least one said wheel set driving said ratchet includes at least a first additional ratchet drive wheel coaxial with a pinion driving said ratchet, said first additional ratchet drive wheel being pivotally mounted on an arbor comprised in said wheel set driving said ratchet, and connected to said arbor by first elastic rotational return means or at least a first spring constituting said uncoupling mechanism during the operation of said manual winding mechanism actuated by the user.

6. The movement according to claim 5, wherein, some of said uncoupling mechanism, constituted by said first elastic rotational return means or by said at least one first spring, exert a friction force on first additional ratchet drive wheel, whose moment of torque is different according to the relative pivoting direction between said uncoupling mechanism and said first additional ratchet drive wheel.

7. The movement according to claim 5, wherein said first spring is arranged to generate a unidirectional pivoting direction with no play of said first additional ratchet drive wheel relative to said arbor of said wheel set driving said ratchet, so as to prevent any transmission of torque to said train during the winding of said movement by at least one said winding mechanism.

8. The movement according to claim 5, wherein at least one said winding mechanism is an automatic winding mechanism, and in that at least one said wheel set driving said ratchet further includes a second additional ratchet drive wheel, said second additional ratchet drive wheel being pivotally mounted on said arbor and connected to said arbor by second elastic rotational return means or at least a second spring constituting some of said uncoupling mechanism during the operation of said automatic winding mechanism.

9. The movement according to claim 8, wherein some of said uncoupling mechanism, constituted by said second elastic rotational return means or by said at least one second spring, exert a friction force on second additional ratchet drive wheel, whose moment of torque is different according to the relative pivoting direction between said uncoupling mechanism and said second additional ratchet drive wheel.

10. The movement according to claim 8, wherein said second spring is arranged to generate a unidirectional direction of pivoting with no play of said second additional ratchet drive wheel relative to said arbor of said wheel set driving said ratchet, so as to prevent any transmission of torque to said going train during the winding of said movement by said manual winding mechanism actuated by the user, or during the operation of said first energy take-up means.

11. The movement according to claim 5, wherein said main spring is arranged to take up the play between an additional intermediate connection wheel meshing with said at least one wheel set driving said rachet and said first additional ratchet drive wheel.

12. The movement according to claim 1, wherein said movement includes at least one regulating member having a balance, and in that said energy take up means constantly take up a mechanical torque from said going train when said regulating member is operating, and in that said balance is dimensioned less than the same movement would be without said energy take up means, so as to maintain an oscillation amplitude sufficient for the proper operation thereof.

13. The movement according to claim 1, wherein said movement includes at least one regulating member having a balance, and in that at least one said winding mechanism is an automatic winding mechanism, and in that said energy take-up means constantly take up a mechanical torque from said going train only when said movement is held in a fixed position in space and when said automatic winding mechanism is inactive, so as to reduce the oscillation amplitude of said balance and to increase the power reserve of said movement.

14. The movement according to claim 1, wherein said winding mechanism includes a manual winding mechanism, which includes a user-actuated stem and which is arranged to drive, in an axial winding position of said stem and in a rotational winding direction imparted thereto by the user, a sliding pinion arranged to mesh with a winding pinion driving a transmission wheel meshing with said ratchet, said transmission wheel being arranged to cooperate with a click including means of taking up backlash between said ratchet and said transmission wheel during an operation of said stem.

15. The timepiece including at least one movement according to claim 1.

* * * * *